US009155931B2

(12) United States Patent
Hetrick

(10) Patent No.: US 9,155,931 B2
(45) Date of Patent: Oct. 13, 2015

(54) STRAP RESTRAINT APPARATUS

(75) Inventor: Randal Hetrick, San Francisco, CA (US)

(73) Assignee: FITNESS ANYWHERE, LLC, San Francisco, CA (US)

( * ) Notice: Subject to any disclaimer, the term of this patent is extended or adjusted under 35 U.S.C. 154(b) by 323 days.

(21) Appl. No.: 13/219,151

(22) Filed: Aug. 26, 2011

(65) Prior Publication Data

US 2012/0053027 A1 Mar. 1, 2012

Related U.S. Application Data

(60) Provisional application No. 61/377,700, filed on Aug. 27, 2010.

(51) Int. Cl.

| | |
|---|---|
| ***A63B 21/00*** | (2006.01) |
| ***A63B 21/04*** | (2006.01) |
| ***A63B 21/055*** | (2006.01) |
| ***A63B 23/035*** | (2006.01) |
| ***A63B 21/068*** | (2006.01) |
| ***A63B 21/16*** | (2006.01) |

(52) U.S. Cl.

CPC ..... *A63B 21/1469* (2013.01); *A63B 21/00043* (2013.01); *A63B 21/00069* (2013.01); *A63B 21/00185* (2013.01); *A63B 21/0442* (2013.01); *A63B 21/0555* (2013.01); *A63B 21/068* (2013.01); *A63B 21/1484* (2013.01); *A63B 21/1663* (2013.01); *A63B 23/03541* (2013.01); *A63B 2225/09* (2013.01)

(58) Field of Classification Search

CPC ..... A63B 21/00185; A63B 21/0442; A63B 21/0555; A63B 21/1469; A63B 21/1484; A63B 21/00043; A63B 21/00069; A63B 21/068; A63B 21/1663; A63B 23/03541

USPC ..... 482/23–24, 37, 91–96, 121–126, 482/129–13, 904, 1, 129–131; 24/306

See application file for complete search history.

(56) References Cited

U.S. PATENT DOCUMENTS 4,774,801 A 10/1988 Johansen et al.
5,158,510 A 10/1992 Lemire (Continued)

OTHER PUBLICATIONS

International Search Report and Written Opinion PCT/US2011/049369, Apr. 9, 2012.

(Continued)

*Primary Examiner* — Loan H Thanh
*Assistant Examiner* — Jennifer M Deichl
(74) *Attorney, Agent, or Firm* — Vedder Price P.C.

(57) ABSTRACT

A strap restraint for a device having adjustable straps is disclosed. In one embodiment, a strap restraint for an adjustable device is provided. The device has a strap with an end that doubles back through a length-adjustment mechanism and over the strap. The strap restraint includes an elastic band attached to the end, where the band encircles the strap, and a pair of flexible inelastic fastening elements attached to the end. The strap restraining permits the user to select the force with which the strap restraint holds the end against the strap.

15 Claims, 6 Drawing Sheets

(56) References Cited

U.S. PATENT DOCUMENTS

| | | | | |
|---|---|---|---|---|
| 5,548,871 | A * | 8/1996 | Trethewey | 24/16 R |
| 5,711,747 | A * | 1/1998 | Steinback | 482/124 |
| 6,368,258 | B1 | 4/2002 | Emlaw | |
| 6,921,357 | B2 * | 7/2005 | Basting | 482/121 |
| 2005/0125965 | A1 * | 6/2005 | Joosten et al. | 24/306 |
| 2007/0066450 | A1 * | 3/2007 | Hetrick | 482/91 |
| 2008/0115248 | A1 | 5/2008 | Meadows | |
| 2008/0127461 | A1 * | 6/2008 | Linden et al. | 24/302 |
| 2009/0075788 | A1 | 3/2009 | Hetrick | |

OTHER PUBLICATIONS

International Bureau, "International Preliminary Report on Patentability" issued in connection with International Application No. PCT/US2011/049369, mailed Mar. 14, 2013, 2 pages.

International Bureau, "Written Opinion of the International Searching Authority" issued in connection with International Application No. PCT/US2011/049369, mailed Mar. 14, 2013, 5 pages.

European Patent Office, "Supplementary Partial European Search Report," issued in connection with European Patent Application No. EP 11820731; completed May 2, 2014, mailed May 9, 2014; 8 pages.

* cited by examiner

STRAP RESTRAINT APPARATUS

CROSS-REFERENCE TO RELATED APPLICATIONS

This application claims the benefit of U.S. Provisional Application No. 61/377,700, filed Aug. 27, 2010, the contents of which are incorporated herein by reference.

FIELD OF THE INVENTION

The present invention generally relates to devices having adjustable straps, and in particular to restraints for straps for adjustable length exercise devices.

BACKGROUND OF THE INVENTION

Resistance exercise devices allow a user to exercise by providing a resistance to the movement of a user's arms, legs, or torso. Thus, for example, such devices allow a user to exercise by working one muscle against another, or by working against the weight of the user, by providing a resistance to the movement of a user's arms, legs, or torso. Resistance exercise devices typically include either elastic bands or inelastic straps.

In some devices, straps of variable length are provided so that the user may adjust the size of the device. It can sometimes be difficult to adjust the length of the straps. In addition, the adjustment sometimes results in excess length that can be distracting or a danger to the user.

There is need to provide straps that are more easily adjusted. There is also a need to provide straps that are configured for any excess length to be easily and safely stowed.

BRIEF SUMMARY OF THE INVENTION

The present invention overcomes certain disadvantages of prior art by providing straps having an easily grippable portion for adjusting the strap length.

In certain embodiments, an adjustable strap for an exercise device is provided. The strap includes a length of cord attached to an end of the strap.

The present invention overcomes certain other disadvantages of prior art by providing a restraining device affixed to the end of exercise device straps.

In certain embodiments, a strap restraint for an adjustable device is provided. The device has a strap with an end that doubles back through a length-adjustment mechanism and over the strap. The strap restraint includes an elastic band attached to the end, where the band encircles the strap, and a pair of flexible elements attached to the end, where the element is inelastic, is of sufficient size to wrap about the strap, and is fastenable to the other element of the pair of elements, The force with which the strap restraint hold the end against the strap is adjustable by fastening the pair of flexible surfaces about the strap.

In certain other embodiments, a strap restraint for an adjustable device is provided. The device has a strap having an end that doubles back over the strap through a strap length adjustment mechanism. The strap restraint includes a first mechanism for holding the end against the strap; and a second mechanism for holding the end against the strap.

In yet other embodiments, an exercise device having adjustable straps and a strap restraint is provided. The exercise device has a strap with an end that doubles back through a length-adjustment mechanism and over the strap. The strap restraint includes an elastic band attached to the end, where the band encircles the strap, and a pair of flexible elements attached to the end, where the element is inelastic, is of sufficient size to wrap about the strap, and is fastenable to the other element of the pair of elements. The force with which the strap restraint holds the end against the strap is adjustable by fastening the pair of flexible surfaces about the strap.

In certain embodiments, an exercise device having adjustable straps and a strap restraint is provided. The exercise device has a strap having an end that doubles back over the strap through a strap length adjustment mechanism. The strap restraint includes a first mechanism for holding the end against the strap; and a second mechanism for holding the end against the strap.

These features together with the various ancillary provisions and features which will become apparent to those skilled in the art from the following detailed description, are attained by the apparatus of the present invention, embodiments thereof being shown with reference to the accompanying drawings, by way of example only, wherein:

Reference symbols and names are used in the Figures to indicate certain components, aspects or features shown therein, with reference symbols common to more than one Figure indicating like components, aspects or features shown therein.

DETAILED DESCRIPTION

Figure 1:
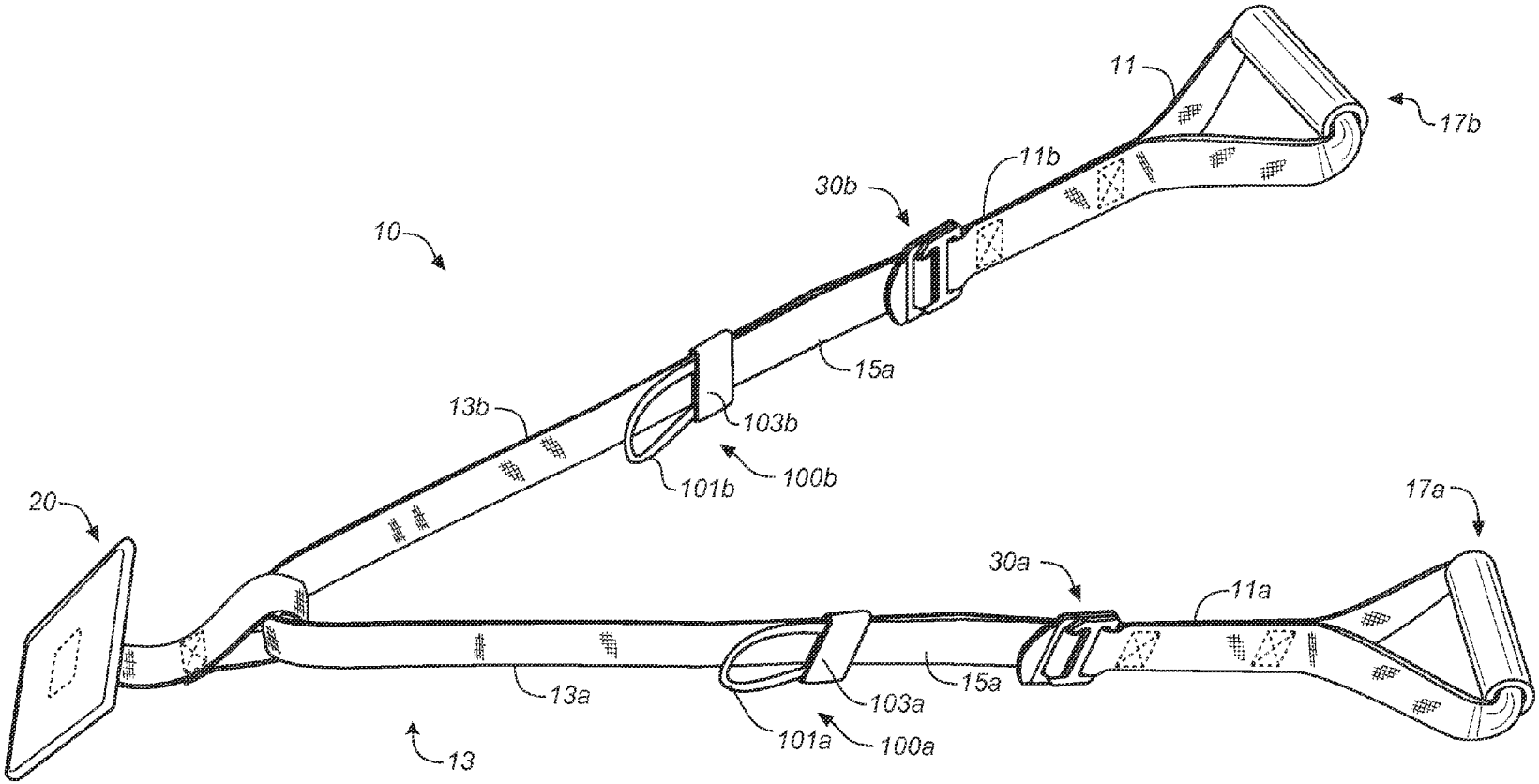
FIG. 1 is a perspective view of one embodiment of strap ends on an exercise device.

FIG. 1 shows a perspective view of an exercise device 10 including one embodiment of strap ends 100, shown individually as strap ends 100*a* and 100*b*. Exercise device 10 is shown for illustrative purposes only, and is not meant to limit the scope of the present invention, except as explicitly claimed.

Exercise device 10, for example, includes a door mount 20, a first inelastic strap 13, and second and third inelastic straps 11*a* and 1*b* terminating in grips 17*a* and 17*b*, respectively. Straps 11*a*, 11*b*, and 13 pass through mechanisms 30, shown as mechanism 30*a* and 30*b* that restrain the movement of strap 13. As is further shown in FIG. 1, strap 13 includes a first portion 13*a* that doubles back through mechanism 30*a* as a portion 15*a* terminating at strap end 100*a*, and a second portion 13*b* that doubles back through mechanism 30*b* as a portion 15*b* terminating at strap end 110*b*. The distance between grips 17*a* and 17*b* may be adjusted according to the length of portions 15*a* and/or 15*b* by pulling strap ends 100*a* and/or 100*b* away from mechanism 30*a* and/or 30*b*.

Examples of exercise device 10 may be found, for example and without limitation, in co-owned U.S. Pat. Nos. 7,044,896 and 7,762,932, the contents of which are incorporated herein by reference.

Each strap end 100 includes a strap pull 101 and a strap restraint 103. Thus, for example, strap end 100*a* has a strap pull 101*a* and a strap restraint 103*a*, and strap end 100*b* has a strap pull 101*b* and a strap restraint 103*b*. As discussed subsequently, strap pull 101 provides a convenient extension of strap 13 to permit the length of the strap to be adjusted. Strap restraint 103 and wraps about strap 13 to keep the strap end from moving about.

Figure 2:
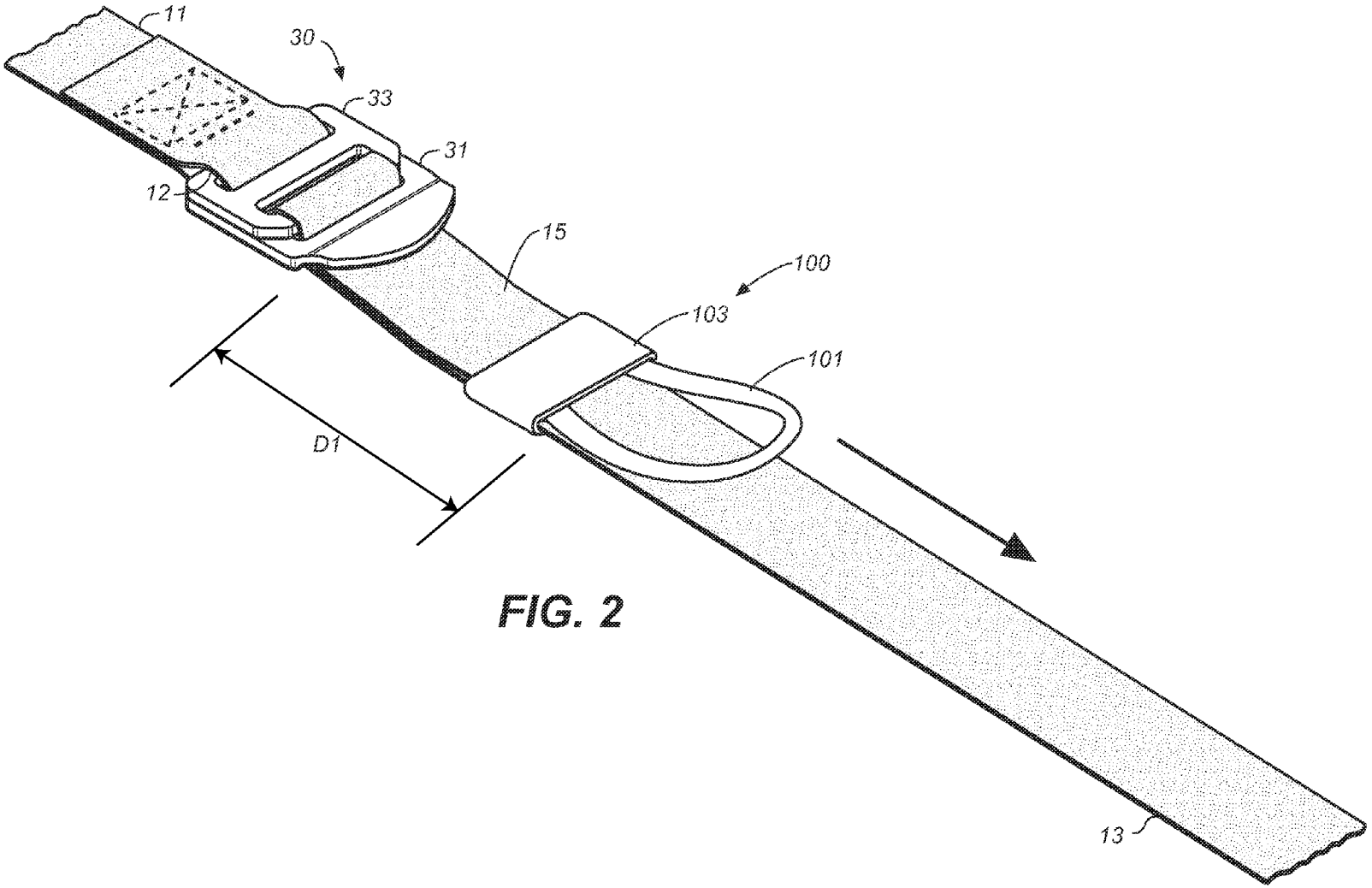
FIG. 2 is a detailed perspective view of a strap end of FIG. 1 at a first position.

FIG. 2 is a detailed perspective view of one strap end 100 provided a first position, D1, as measured from mechanism 30. Strap 11 forms a loop 12 that passes through a ring 31 and a ring 33 of mechanism 30. Mechanism 30 is shown for connecting and adjusting straps 11 and 13 and may be, for example and without limitation, the device described in co-owned and pending in U.S. patent application Ser. No. 13/194,522, the contents of which are incorporated herein by reference. Strap 13 passes through rings 31 and 33, with strap portion 15 extending from mechanism 30 to strap end 100.

Figure 3:
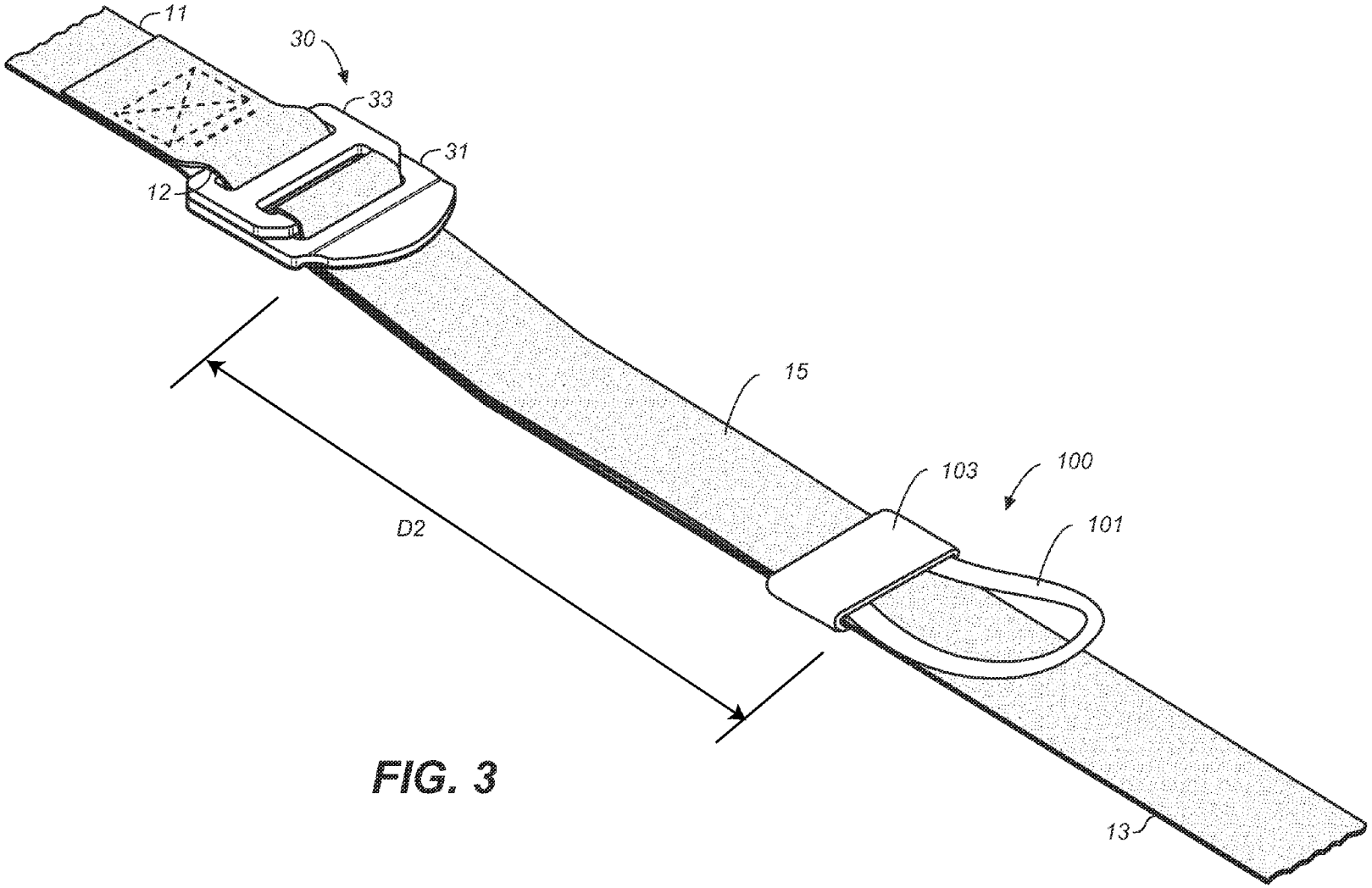
FIG. 3 is a detailed perspective view of the strap ends in a second position.

FIG. 3 is a detailed perspective view of strap end 100 in another configuration. Specifically, strap pull 101 of FIG. 2 has been pulled away from mechanism 30, as shown in by the arrow in FIG. 3, to a larger distance, D2, as shown in FIG. 3, thus shortening the distance between grips 17*a* and 17*b*. The grip-to-grip distance can be lengthened by releasing mechanism 30 and pulling on grips 17*a*/17*b*.

Figure 4A:
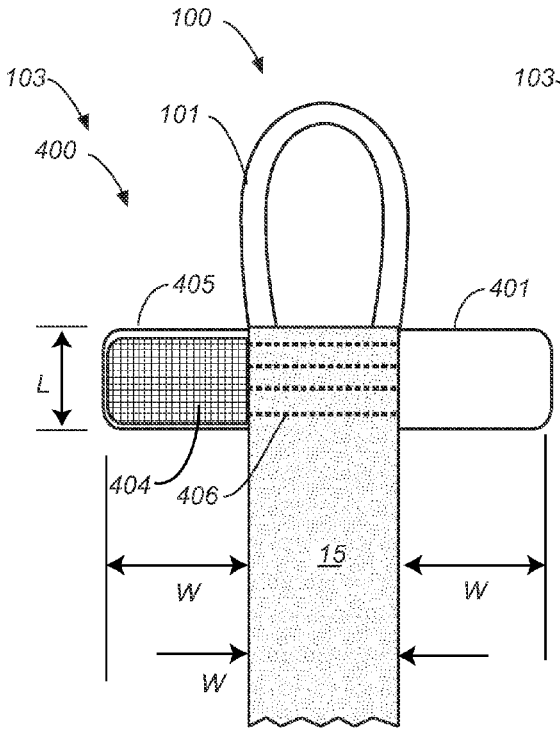
FIGS. 4A and 4B are front and back views, respectively, showing the first steps in the construction of the strap end of FIG. 2.
Figure 4B:
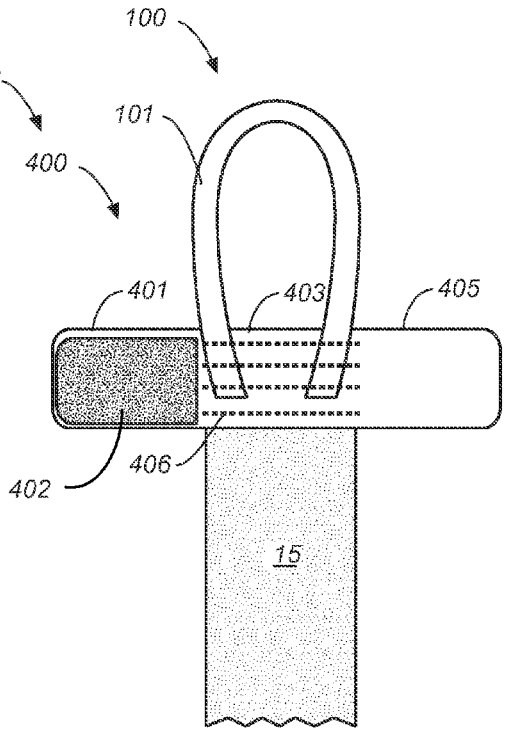
Figure 5A:
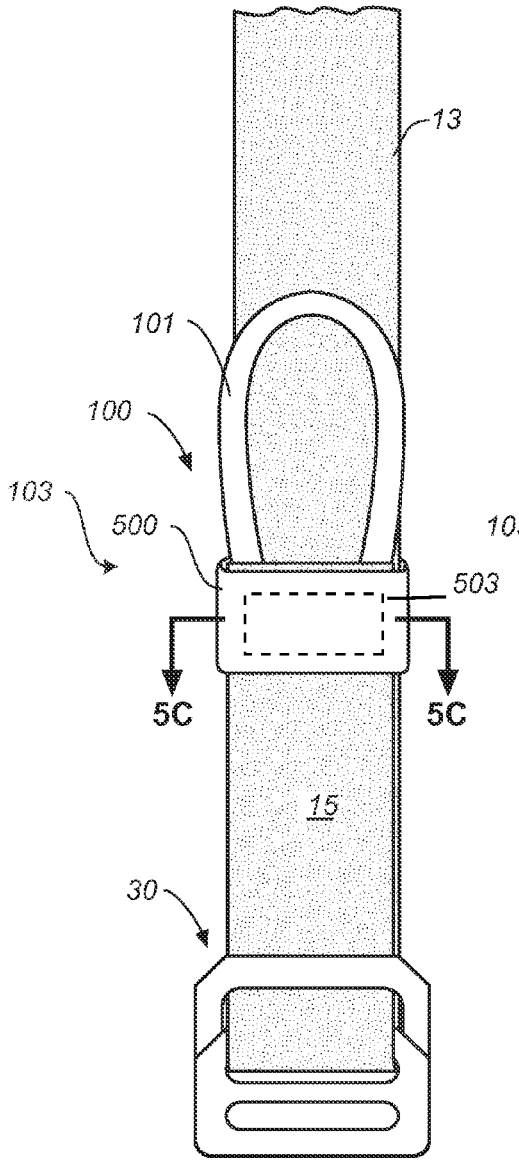
FIGS. 5A and 5B are front and back views, respectively, showing further steps in the construction of the strap end of FIG. 2.
Figure 5B:
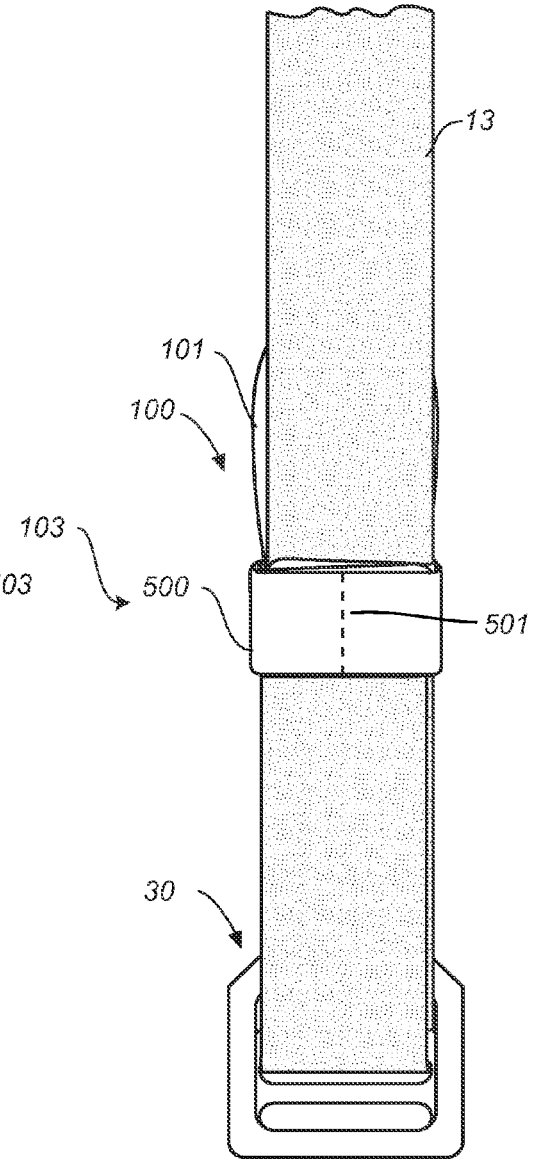
Figure 5C:
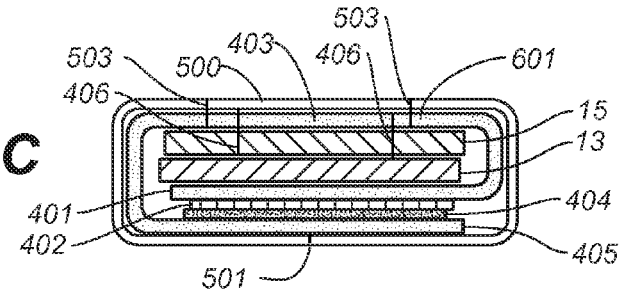
FIG. 5C is a sectional view 5C-5C of FIG. 5A.

FIGS. 4A, 4B, 5A, 5B, and 5C illustrate the construction of one embodiment of strap end 100, where FIGS. 4A and 4B and are front and back views, respectively, showing the first steps in the construction of the strap end of FIG. 2, FIGS. 5A and 5B are front and back views, respectively, showing further steps in the construction of the strap end of FIG. 2, and FIG. 5C is a sectional view 5C-5C of FIG. 5A.

As shown in FIGS. 4A and 4B, strap restraint 103 includes a piece of material 400 having a length L and width 3 W, where W is the width of strap portion 17. Material 400 forms a central portion 403 that, along with strap pull 101, is attached to the end of strap portion 17 by stitching 406. Material 400 also includes with equally sized wings 401 and 405 that extend away from the strap portion. Wing 401 has a fastening surface 402 on one side of material 400, and wing 405 has a matching fastening surface 404 on the opposite side of material 400. Matching surfaces 402 and 404 may be, for example and without limitation, a pair of matching hook and loop surfaces of a set of hook-and-loop fasteners.

Next, as shown in FIGS. 5A, 5B, and 5C, strap restraint 103 further includes a material 500 which is an elastic material sewn into a loop by stitching 501 and is attached to central portion 403 by stitching 503. As shown in more detail in FIG. 5C, wings 401 and 405 may be surrounded by elastic material 500. Strap restraint 103 thus holds portion 15 against strap 13 with fasteners—that is, by wing 401 folded first, then wing 405 folded over wing 401—and with the elastic of material 500.

Figures 6A, 6B:
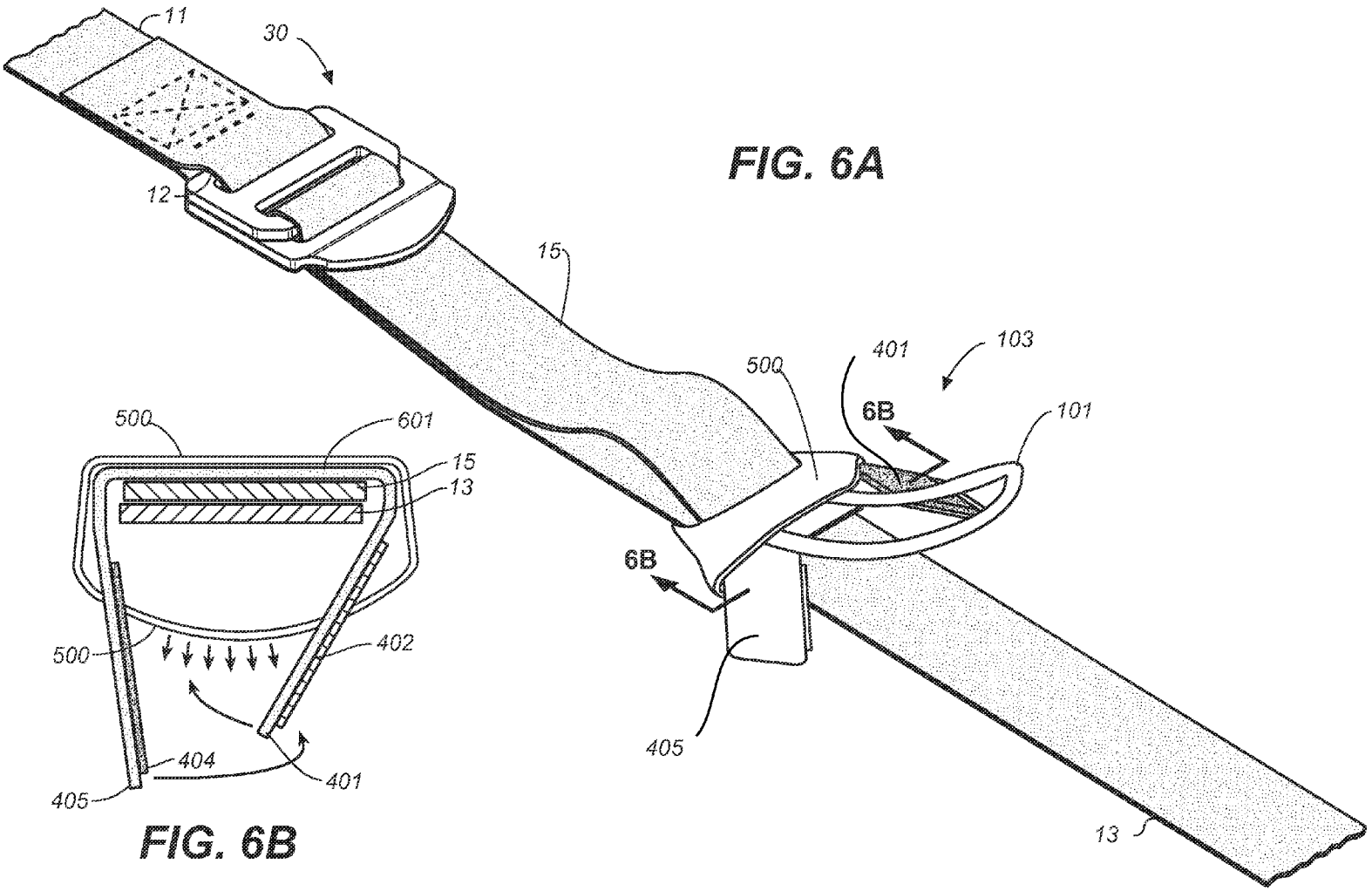
FIGS. 6A and 6B are a perspective view and a sectional view 6B-6B, respectively, illustrating a method for loosening or tightening the strap restraint of FIG. 2.

FIGS. 6A and 6B are a perspective view and a sectional view 6B-6B, respectively, illustrating a method for loosening or tightening the strap restraint of FIG. 2. Material 500 may be pulled way from strap 13, permitting wings 401 and 405 to be moved and adjusted to control the force by which strap restraint 103 holds strap end 101 to strap 13.

In an alternative embodiment, strap restraint 103 includes wings 401 and 405, but does not include the outer covering of material 500.

The material of strap 13 and material 400 may be, for example, a nylon webbing, such as a CORDURA® webbing. In one embodiment, W is 37 mm and L is 23 mm. The material of strap pull 101 may be, in general, any cord-like material that is relatively inelastic. The material of strap pull 101 may be, for example from 1 to 10 mm in diameter, and may form a loop that extends from 1 cm to 10 cm from the end of strap portion 17. In one embodiment, the material of strap pull 101 is a 12 cm length of a 7 mm nylon woven cord formed into a loop approximately 6 cm in size. Material 500 may be, for example and without limitation, a 23 mm wide elastic band.

Although the invention(s) presented herein have been disclosed in the context of certain preferred embodiments and examples, it will be understood by those skilled in the art that the invention(s) extend beyond the specifically disclosed embodiments to other alternative embodiments and/or uses of the invention(s) and obvious modifications and equivalents thereof. Thus, it is intended that the scope of the invention(s) herein disclosed should not be limited by the particular embodiments described above, but should be determined only by a fair reading of the claims that follow.

What is claimed is:

1. A strap restraint attached to an adjustable device having a strap with an end that doubles back through a length-adjustment mechanism and over the strap, the strap restraint comprising:

an elastic band attached to the end, where the band encircles the strap; and a pair of flexible elements attached to the end, where each one of the pair of flexible elements is inelastic, is of sufficient size to wrap about the strap, and is fastenable to the other element of the pair of flexible elements, such that the force with which the strap restraint holds the end against the strap is adjustable by fastening the pair of flexible elements about the strap, wherein the elastic band is configured to surround the pair of flexible elements and wherein the pair of flexible elements is attached to the end by first stitching and the elastic band is attached to a central portion of pair of flexible elements by second stitching.

2. The strap restraint of claim 1, where the strap has a width W, where each of the pair of elements extends away from the strap by approximately a length W, where each of the pair of elements has one of a pair of fastening surfaces, and where the elements are fastened folding each surface around the strap.

3. The strap restraint of claim 2, where each of the pair of elements includes one of a hook and loop surface of a hook and loop fastener.

4. The strap restraint of claim 1, further including a strap pull including a loop of material fastened to the strap end.

5. An exercise device having adjustable straps and a strap restraint of claim 1.

6. A strap restraint attached to an adjustable device including a strap having an end that doubles back over the strap through a strap length adjustment mechanism, the strap restraint comprising:

a first mechanism for holding the end against the strap; and a second mechanism comprising an adjustable band for holding the end against the strap, wherein the first mechanism is configured to surround the second mechanism and the second mechanism is configured to surround the strap and the end, where the second mechanism is attached to the end by first stitching and the first mechanism is attached to the second mechanism by second stitching.

7. The strap restraint of claim 6, where the first mechanism includes an elastic band.

8. The strap restraint of claim 6 where the adjustable band includes a pair of flexible elements fastenable to each other.

9. The strap restraint of claim 8, where each of the pair of flexible elements includes one of a hook and loop surface of a hook and loop fastener.

10. The strap restraint of claim 6, further including a strap pull including a loop of material fastened to the strap end.

11. An exercise device having adjustable straps including a strap having an end that doubles back over the strap through a strap length adjustment mechanism, said exercise device comprising:

a strap restraint including:

a first mechanism comprising an elastic band for holding the end against the strap; and a second mechanism for holding the end against the strap, wherein the first mechanism is configured to surround the second mechanism and the second mechanism is configured to surround the strap and the end, wherein the second mechanism is attached to the end by first stitching and the first mechanism is attached to the second mechanism by second stitching.

12. The strap restraint of claim 11, where the second mechanism includes an adjustable band.

13. The exercise device of claim 12, where the adjustable band includes a pair of flexible elements fastenable to each other.

14. The exercise device of claim 13, where each of the pair of flexible elements includes one of a hook and loop surface of a hook and loop fastener.

15. The exercise device of claim 11, further including a strap pull including a loop of material fastened to the strap end.

* * * * *